US008181686B2

(12) United States Patent
Hungler et al.

(10) Patent No.: US 8,181,686 B2
(45) Date of Patent: May 22, 2012

(54) INSTALLATION FOR ASSEMBLING TWO WEBS OF TISSUE PAPER WITH OR WITHOUT MARKING OF SAID WEBS

(75) Inventors: Joel Hungler, Ailly (FR); Yves-Michel Malecot, Crosville la Vieille (FR)

(73) Assignee: Georgia-Pacific France (FR)

( * ) Notice: Subject to any disclaimer, the term of this patent is extended or adjusted under 35 U.S.C. 154(b) by 139 days.

(21) Appl. No.: 12/422,465

(22) Filed: Apr. 13, 2009

(65) Prior Publication Data

US 2009/0255622 A1 Oct. 15, 2009

(30) Foreign Application Priority Data

Apr. 15, 2008 (FR) ..... 08 02079

(51) Int. Cl.
*B31F 1/07* (2006.01)

(52) U.S. Cl. ..... 156/471; 156/470

(58) Field of Classification Search ..... None
See application file for complete search history.

(56) References Cited

U.S. PATENT DOCUMENTS 2,822,855 A 2/1958 Sproull et al.
5,269,983 A * 12/1993 Schulz ..... 264/400
5,529,563 A * 6/1996 Veith et al. ..... 493/395
2002/0048662 A1* 4/2002 Bredahl et al. ..... 428/195
2003/0075262 A1* 4/2003 Hein et al. ..... 156/209

FOREIGN PATENT DOCUMENTS

DE 202004009626 U1 9/2004
WO 98/53985 A1 12/1998
WO 02/42061 A1 5/2002
WO 2005/085526 A2 9/2005

OTHER PUBLICATIONS

Search Report that issued in FR 0802079 on Dec. 4, 2008.
Written Opinion that issued in FR 0802079.

* cited by examiner

*Primary Examiner* — John L. Goff
*Assistant Examiner* — Barbara J. Musser
(74) *Attorney, Agent, or Firm* — Laura L. Bozek

(57) ABSTRACT

The disclosure relates an apparatus and method for assembling at least two webs of tissue paper with or without marking of the webs. The apparatus and method utilize a multi-marrying roller configuration, which allows for assembling of the at least two webs of tissue paper by passing between the marrying roller and the second marrying roller. The apparatus and method make it possible to produce a conventional embossed product, or a smooth product without marking, having combined plies. In addition, the apparatus and method make it possible to easily move from one production mode to the other.

16 Claims, 1 Drawing Sheet

INSTALLATION FOR ASSEMBLING TWO WEBS OF TISSUE PAPER WITH OR WITHOUT MARKING OF SAID WEBS

CROSS-REFERENCE TO RELATED APPLICATION

This application claims priority to French patent application 08 02079, filed Apr. 15, 2008, and all the benefits accruing therefrom under 35 U.S.C. §119, the contents of which are herein incorporated by reference.

BACKGROUND

1. Field

The present disclosure relates to the field of products made of tissue paper for sanitary or domestic use and more particularly targets an embossing and assembling installation for manufacturing multi-ply products.

2. Description of Related Art

In the aforementioned field, products are manufactured as rolls composed, in general, of at least two plies of tissue paper. The tissue paper is a sheet of paper having a low basis weight, between 10 and 50 g/m$^2$, that is obtained on paper-making machines designed and controlled in order to give it properties of mechanical strength, softness and absorbency with respect to the application for which it is intended. The formed sheet is wound on a reel and stored as a semi-finished product. The machines for manufacturing this type of paper are well known. The semi-finished product is subsequently converted to rolls or into formats having dimensions suitable for their use. The converting consists of the assembly of several plies into one multi-ply sheet with or without an embossing step, with or without a knurling step, making into rolls or into formats and cutting to the commercial size. The embossing makes it possible, in particular, to increase the thickness of the sheet, by modifying its mechanical properties.

There are several methods for assembling sheets. It is possible, for example, to simply superpose several plies, so as to obtain a sheet having a higher basis weight and to connect them together mechanically, by knurling for example and/or by adhesive bonding. It is possible to emboss one or more plies before assembling according to a pattern composed of discrete or continuous protuberances, so as to give the sheet more volume and improve its softness, its ability to absorb liquids and/or its attractiveness.

In a known manner, one converting installation generally comprises one or more embossing groups, with, where appropriate, an adhesive applicator. In order to emboss one ply, an embossing group is used that comprises a rigid roller, engraved on the surface with a pattern in relief as desired, and for example a roller having a deformable coating, generally made of an elastomer. The ply to be embossed is guided between the two rollers that roll against one another. The pressure exerted by the deformable roller on the ply leads to a more or less pronounced deformation of the latter which matches the relief of the engraved roller. The embossing groups are provided with means for rotating the rollers and also for controlling their separation.

In order to produce a sheet assembled in such a way that the protuberances of the relief are positioned tip-to-tip, two plies are embossed separately, then the two plies are brought close to one another so as to make all or part of the peaks of the protuberances of the two plies coincide, after having adhesively bonded at least one part thereof. The installation for producing this type of sheet comprises two separate embossing groups positioned so that all or part of the peaks of the protuberances of the two engraved rollers come into contact through the two plies that are guided between them.

Another method of assembling plies that form one sheet is known under the name of "nested". The protuberances of one ply are nested between those of the facing ply. To produce this assembly, the two plies are embossed separately on two separate embossing groups; one ply is detached from the engraved roller on which it has been embossed then it is applied to the other ply still pressing against the roller with which it was itself embossed. Adhesive has previously been applied to the peak of the protuberances of the latter ply. The combination of this ply with the other one is carried out via a roller known as a marrying roller, which exerts pressure on the whole assembly allowing the two plies to be joined.

Some applications require production of sheets that comprise several combined, but not embossed plies for certain uses, such as, for example in the field of wiping.

A first known installation that enables the combination of plies is shown schematically in FIG. 1. The installation comprises a smooth roller 1A1 and knurling wheels 1M1 and 1M2. The pressure of the knurling wheels on the combined plies may be sufficient to mechanically bond them without adhesive, but the pressure exerted must be particularly high. In this case, the imprint of the knurling wheels inevitably remains; moreover, it cannot be spread homogeneously, generating an irregular "rendering".

FIG. 2 schematically shows a conventional installation for manufacturing a product of tip-to-tip type where a first embossing group 2C1-2A1 (rubber (C)-steel (A) comprising protuberances) is positioned in order to cooperate with a second equivalent group 2C2-2A2. In order to manufacture the two plies without marking, it could be imagined to separate the two rubber rollers 2C1 and 2C2 from their associated respective rigid roller 2A1 and 2A2. This solution would thus make it possible to produce, on one and the same installation, "embossed tip-to-tip" or "smooth" plies. The change in format could be carried out without modifying the passage of the sheet; it would be sufficient to apply or not the rollers 2C1 and 2C2. To combine the two plies together, it remains to deposit the adhesive with the applicator group BTA and to bond the two plies by exerting a sufficient joining pressure between the two rollers 2A1 and 2A2. Unfortunately, this solution has the drawback of not preventing the marking of the sheet when it passes between the two rigid rollers 2A1 and 2A2.

FIG. 3 shows another solution that uses a single embossing group comprising a deformable roller made of an elastomer 3C1 and a rigid roller with protuberances (made of steel) 3A1 associated with a marrying roller 3M. The installation would make it possible to manufacture a sheet with an embossed or non-embossed ply, depending on whether the rubber roller 3C1 would be pressed against the steel roller 3A1 or not. However, as before, it is not possible to avoid marking during passage in the bonding zone. If the roller 3M is soft the multi-ply sheet is embossed, which is not the desired solution; if the roller is hard, it is not possible to avoid the marking caused by the protuberances of the roller 3A1.

FIG. 4 shows an installation for manufacturing a "nested" type product. The installation comprises two embossing groups 4C1-4A1 and 4C2-4A2. The two plies are embossed separately, respectively between the rollers 4C1-4A1 and 4C2-4A2, and then they are joined by means of a marrying roller 4M. By separating the two rollers 4C1 and 4C2 from their associated rigid roller, the two plies are not embossed. This arrangement therefore makes it possible, as in the preceding propositions, to manufacture one of the embossed or non-embossed plies. However, it is not possible to avoid marking the sheet when it passes between the marrying roller 4M and the associated steel roller 4A1, since the roller 4M inevitably presses the sheet against the protuberances of the roller 4A1 in order to bring about the joining of the plies.

SUMMARY

The Applicant has developed a method of producing an installation that would make it possible to produce a conventional embossed product, or a smooth product without marking, having combined plies.

Another objective is to produce an installation which would make it possible to easily move from one production mode to the other.

These objectives have successfully been achieved with an installation for assembling at least two webs of tissue paper with or without marking of said webs, comprising a first embossing group with a rigid roller provided with embossing protuberances and a roller having a deformable coating which may be pressed against the rigid roller for embossing a first web of tissue paper by passing the first web between the rigid roller and the roller having a deformable coating, and also a marrying roller, which may be applied against the rigid roller so as to marry the first web to a second web, the two webs being guided between the marrying roller and the rigid roller of the first embossing group. This installation is characterized by the fact that it comprises an additional marrying roller, which may be pressed against the marrying roller so as to allow the assembling of the two webs of tissue paper by passing between the marrying roller and the additional marrying roller, the assembling being without marking when the first web passes around the first rigid roller without the roller having a deformable coating pressing against the rigid roller and the assembling being with marking when the first web passes around the first rigid roller with the roller having a deformable coating pressing against the rigid roller.

By carrying out the joining of the two plies between the two marrying rollers in the mode of production without embossing, the same flat product is obtained as with a conventional calendering installation. The two rollers in fact behave as a calender, with the improvement in the softness that results therefrom. Furthermore, no strength is lost since there is no deformation of one or the other of the two plies.

In accordance with one embodiment, the marrying roller is positioned between the rigid roller of the first embossing group and the additional marrying roller and can be moved between a first joining position between the rigid roller and the marrying roller and a second joining position between the marrying roller and the additional marrying roller.

Additionally, the installation can contain an adhesive bonding unit for applying adhesive to the first web of tissue paper. This unit advantageously contains an adhesive-applicator roller for applying the adhesive to the surface of the first web when this is positioned on the rigid roller.

According to one variant, the adhesive-applicator device comprises a means for spraying adhesive between the two plies.

More particularly, the installation can contain a second embossing group, for embossing the second web of tissue paper.

The disclosure relates particularly to a process for manufacturing a bonded and unmarked sheet from two webs of tissue, comprising the passage of a first web of tissue paper into the first embossing group of the installation, without it being embossed, then passage of this first web with a second web of tissue paper between the marrying roller and the additional marrying roller.

BRIEF DESCRIPTION OF THE DRAWINGS

A non-limiting embodiment of the invention will now be described with reference to the appended drawings in which.

DETAILED DESCRIPTION

Aspects, advantages, and features of exemplary embodiments of the invention and methods of accomplishing the same may be understood more readily by reference to the following detailed description of embodiments and the accompanying drawings. The exemplary embodiments of the invention may, however, may be embodied in many different forms, and should not be construed as being limited to the embodiments set forth herein. Rather, these embodiments are provided so that this disclosure will be thorough and complete and will fully convey the concept of the invention to those skilled in the art, and the exemplary embodiments of the invention will only be defined by the appended claims.

As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1:
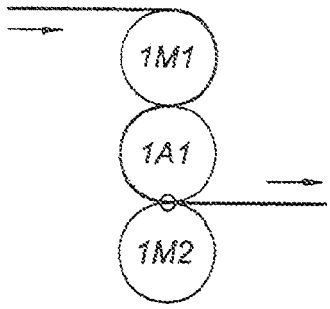
Fig. 1 (Prior Art)
FIG. 1 schematically represents an installation according to the prior art that makes it possible to produce sheets from several plies bonded together by knurling.
Figure 2:
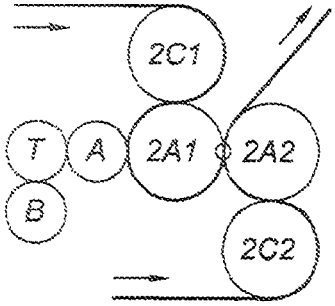
Fig. 2 (Prior Art)
FIG. 2 schematically represents an installation according to the prior art for manufacturing a sheet of the type that is joined tip-to-tip.
Figure 3:
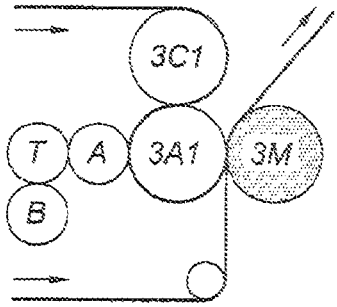
Fig. 3 (Prior Art)
FIG. 3 schematically represents another installation according to the prior art with a single embossing group.
Figure 4:
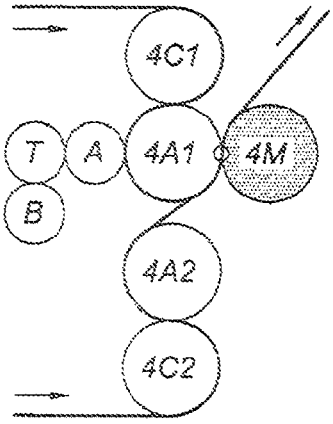
Fig. 4 (Prior Art)
FIG. 4 schematically represents an installation according to the prior art for manufacturing "nested" type products.
Figure 5:
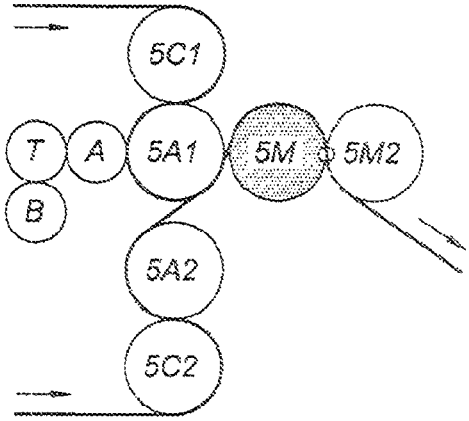
FIG. 5 shows a converting installation according to the invention, comprising an additional marrying roller.

Illustrated in FIG. 5 is an installation for which the majority of the components correspond to the installation from FIG. 4. It comprises a first embossing group having a rigid roller 5A1, made of engraved steel for example, that cooperates with a roller having a deformable coating 5C1. The engraving pattern may be of any type and may comprise protuberances known as embossing protuberances. The second embossing group also itself comprises an engraved rigid roller 5A2 that cooperates with a roller having a deformable coating 5C2. The patterns of the two engravings on the rigid rollers are compatible with one another, so that the plies that result from the two embossing groups can join together in a "nested" configuration. According to this assembly mode, the protuberances of a first ply are placed between the protuberances of the second ply. Thus, the two plies nest one inside the other. An adhesive bonding group shown schematically by the components BTA applies adhesive to the protuberances of the first web 10 in place on the roller 5A1. The installation comprises a marrying roller 5M having an axis parallel to that of the rigid roller 5A1. This part of the installation corresponds to that of the prior art illustrated in FIG. 4. According to the invention, an additional marrying roller 5M2 is added to this installation. This roller preferably has an axis parallel to that of the marrying roller 5M.

Optionally, and in accordance with one embodiment variant, the installation comprises a third embossing group and a marrying roller. The additional marrying roller 5M2 according to one embodiment is the marrying roller at the third embossing group which has not been illustrated.

The operation of the installation is as follows.

When it is desired to manufacture a sheet of the conventional "nested" type, the two deformable rollers 5C1 and 5C2 are placed in position by which the plies 10 and 20 respectively are entrained in the pinch gaps that they form with their respective engraved roller 5A1 and 5A2. The marrying roller 5M presses against the roller 5A1. The first ply 10 is embossed by passing into the pinch gap between the rollers 5C1 and 5A1. Adhesive is deposited by the bonding group BTA onto the peaks of the protuberances created by the embossing of the first ply 10 on the roller 5A1. Furthermore, the second ply 20 is embossed by passing between the rollers 5A2 and 5C2, and then is unstuck from the roller 5A2 in order to join up with the ply 10 still on roller 5A1. The marrying roller 5M applies a pressure to the sheet formed by the two plies 10 and 20, thus ensuring their bonding on the roller 5A1. The sheet is then guided to a station for rolling up the sheet and for cutting the roll into individual rolls.

When it is desired to manufacture a non-embossed product, the two rollers 5C1 and 5C2 are moved away from their associated embossing roller, 5A1 and 5A2 respectively, so that the plies 10 and 20 are not embossed by passing around the rollers 5A1 and 5A2. The marrying roller 5M is moved so that it no longer exerts pressure on the roller 5A1, but so that it presses the sheet formed by the two plies 10 and 20 against the additional marrying roller 5M2 leading to the joining of said plies. Insofar as the two rollers 5M and 5M2 are smooth, the product that exits therefrom is itself also perfectly smooth, while being perfectly joined, and in particular while optimizing its softness.

There are many advantages to this solution:

- the production mode is changed very simply without modifying the course of the plies;
- the passage between the two joining rollers makes it possible to calibrate the sheet;
- no change in the appearance of the smooth product is observed as a function of the wear of the deformable rollers;
- the pattern of the engraved rollers does not appear on the smooth product;
- the product is perfectly symmetrical; and
- if desired, it is possible to color the adhesive and make the pattern of the engraved roller 5A1 appear as decoration.

The adhesive bonding of the sheet is limited to the surface of the protuberances on the roller 5A1. The rigidity is therefore not increased by changing from an embossed product to a smooth product.

It is possible to join more than two plies, preferably for light basis weights.

The process according to the invention for assembling a sheet can also be applied to an installation that uses a single embossing group or a "tip-to-tip" configuration, as well as to any installation from the prior art.

We claim:

1. An apparatus for assembling at least two webs of tissue paper with or without marking of said webs, comprising a first embossing group with a rigid roller provided with embossing protuberances and a roller having a deformable coating which may be pressed against the rigid roller for embossing a first web of tissue paper by passing the first web between the rigid roller and the roller having a deformable coating, and a marrying roller, which is selectively applied against the rigid roller so as to marry the first web to a second web, the at least two webs being guided between the marrying roller and the rigid roller of the first embossing group, wherein the apparatus comprises an additional marrying roller, which is selectively pressed against the marrying roller so as to allow the assembling of the at least two webs of tissue paper by passing between the marrying roller and the additional marrying roller, wherein the assembling is without marking when the first web passes around the first rigid roller without the roller having a deformable coating pressing against the rigid roller and wherein the assembling is with marking when the first web passes around the first rigid roller with the roller having a deformable coating pressing against the rigid roller, wherein the apparatus further comprises a second embossing group for embossing the second web of tissue paper and a third embossing group and a marrying roller associated with the third embossing group, wherein the additional marrying roller is the marrying roller associated with the third embossing group.

2. The apparatus according to claim 1, wherein the marrying roller is positioned between the rigid roller of the first embossing group and the additional marrying roller and wherein the marrying roller can be moved between a first joining position between the rigid roller and the marrying roller and a second joining position between the marrying roller and the additional marrying roller.

3. The apparatus as claimed in claim 1, comprising an adhesive bonding unit for applying adhesive to the first web of tissue paper.

4. The apparatus according to claim 3, wherein the adhesive bonding unit comprises an adhesive-applicator roller for transferring the adhesive to the surface of the first web when positioned on the rigid roller.

5. The apparatus according to claim 3, wherein the adhesive bonding unit comprises a means for spraying adhesive onto the surface of at least one of the webs.

6. The apparatus according to claim 1, wherein the joining of the webs is conducted by pressing between the rigid roller and the marrying roller or between the marrying roller and the additional marrying roller.

7. An apparatus for assembling at least two webs of tissue paper, the apparatus comprising:

- a first embossing group, the first embossing group comprising:
  - a first rigid roller having a surface with embossing protuberances;
  - a first deformable roller having a deformable coating, the first rigid roller and the first deformable roller being arranged to define a first gap therebetween;
- a second embossing group, the second embossing group comprising:
  - a second rigid roller having a surface with embossing protuberances;
  - a second deformable roller having a deformable coating, the second rigid roller and the second deformable roller being arranged to define a second gap therebetween,
- a first marrying roller having a smooth surface, the first marrying roller and the first rigid roller arranged to define a third gap therebetween, a position of the first marrying roller being adjustable relative to the first rigid roller;
- a second marrying roller having a smooth surface, the second marrying roller and the first marrying roller arranged to define a fourth gap therebetween a position of the second marrying roller being adjustable relative to the first marrying roller.

8. The apparatus of claim 7, wherein the apparatus defines a first path for a first web of tissue product, the first path including the first gap, the third gap, and the fourth gap.

9. The apparatus of claim 7, wherein the apparatus defines a second path for a second web of tissue product the second path including the second gap, the third gap, and the fourth gap.

10. The apparatus of claim 7, wherein the apparatus further comprises an adhesive-applicator roller in contact with the first rigid roller.

11. An apparatus for assembling at least two webs of tissue paper with or without marking of said webs, comprising a first embossing group with a rigid roller provided with embossing protuberances and a roller having a deformable coating which may be pressed against the rigid roller for embossing a first web of tissue paper by passing the first web between the rigid roller and the roller having a deformable coating, and a marrying roller, which is selectively applied against the rigid roller so as to marry the first web to a second web, the at least two webs being guided between the marrying roller and the rigid roller of the first embossing group, wherein the apparatus comprises an additional marrying roller, which is selectively pressed against the marrying roller so as to allow the assembling of the at least two webs of tissue paper by passing between the marrying roller and the additional marrying roller, wherein the assembling is without marking when the first web passes around the first rigid roller without the roller having a deformable coating pressing against the rigid roller and wherein the assembling is with marking when the first web passes around the first rigid roller with the roller having a deformable coating pressing against the rigid roller, wherein the marrying roller is positioned between the rigid roller of the first embossing group and the additional marrying roller and wherein the marrying roller can be moved between a first joining position between the rigid roller and the marrying roller and a second joining position between the marrying roller and the additional marrying roller.

12. The apparatus as claimed in claim 11, comprising an adhesive bonding unit for applying adhesive to the first web of tissue paper.

13. The apparatus according to claim 12, wherein the adhesive bonding unit comprises an adhesive-applicator roller for transferring the adhesive to the surface of the first web when positioned on the rigid roller.

14. The apparatus according to claim 12, wherein the adhesive bonding unit comprises a means for spraying adhesive onto the surface of at least one of the webs.

15. The apparatus according to claim 11, comprising a second embossing group for embossing the second web of tissue paper.

16. The apparatus according to claim 11, wherein the joining of the webs is conducted by pressing between the rigid roller and the marrying roller or between the marrying roller and the additional marrying roller.

* * * * *